US012055030B2

(12) United States Patent
Brana et al.

(10) Patent No.: US 12,055,030 B2
(45) Date of Patent: Aug. 6, 2024

(54) SYSTEMS AND METHODS FOR CONTROLLING A DRILLING OPERATION

(71) Applicant: WEATHERFORD TECHNOLOGY HOLDINGS, LLC, Houston, TX (US)

(72) Inventors: Jose D. Brana, Cypress, TX (US); Ademola A. Ajibade, Katy, TX (US); Brian Mickens, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 9 days.

(21) Appl. No.: 17/740,739

(22) Filed: May 10, 2022

(65) Prior Publication Data

US 2023/0366307 A1 Nov. 16, 2023

(51) Int. Cl.
*E21B 44/02* (2006.01)
*E21B 21/08* (2006.01)

(52) U.S. Cl.
CPC ..... *E21B 44/02* (2013.01); *E21B 21/08* (2013.01)

(58) Field of Classification Search
CPC ..... E21B 44/00; E21B 21/08
See application file for complete search history.

(56) References Cited

U.S. PATENT DOCUMENTS

| | | | |
|---|---|---|---|
| 8,833,488 | B2 | 9/2014 | Knudsen et al. |
| 9,528,334 | B2 | 12/2016 | Davis et al. |
| 10,077,647 | B2 | 9/2018 | Johnson et al. |
| 10,329,860 | B2 | 6/2019 | Boutalbi et al. |
| 10,920,579 | B2 | 2/2021 | Beaman, Jr. et al. |
| 2009/0166086 | A1 | 7/2009 | Sugiura |
| 2011/0202275 | A1* | 8/2011 | Beisel ..... E21B 47/06 702/6 |
| 2013/0112404 | A1 | 5/2013 | Lovorn et al. |
| 2016/0024905 | A1 | 1/2016 | Johnson et al. |
| 2016/0138350 | A1 | 5/2016 | Havre et al. |
| 2017/0096889 | A1 | 4/2017 | Blanckaert et al. |
| 2021/0248500 | A1 | 8/2021 | Amur Varadarajan et al. |
| 2021/0270097 | A1 | 9/2021 | Ng et al. |
| 2022/0049554 | A1 | 2/2022 | Groover et al. |

OTHER PUBLICATIONS

Weatherford; "Victus Intelligent MPD", company article No. 13010.00, dated 2019, 12 pages.

International Search Report with Written Opinion issued Jun. 14, 2023 for PCT Patent Application No. PCT/IB2023/052890, 13 pages.

* cited by examiner

*Primary Examiner* — Dany E Akakpo
(74) *Attorney, Agent, or Firm* — Smith IP Services, P.C.

(57) ABSTRACT

A method can include determining that measured outputs of first and second sensors are correlated, calculating a second sensor output based on the measured first sensor output, and in response to a loss of the measured second sensor output or a failure of an item of equipment, controlling a drilling operation based on the calculated second sensor output. A control system can include a statistical model that determines a correlation between measured outputs of first and second sensors, and calculates a calculated second sensor output based on the measured first sensor output, a controller that controls the drilling operation, and a hydraulics model that determines how the drilling operation should be controlled to achieve a desired objective, and determines, based on the calculated second sensor output, how the drilling operation should be controlled, in response to a loss of the measured second sensor output or an equipment failure.

18 Claims, 3 Drawing Sheets

SYSTEMS AND METHODS FOR CONTROLLING A DRILLING OPERATION

BACKGROUND

This disclosure relates generally to equipment utilized and operations performed in conjunction with a subterranean well and, in an example described below, more particularly provides systems and method for controlling a drilling operation.

In a drilling operation, sensors are typically used to measure various parameters that are important for controlling the drilling operation. Unfortunately, if a sensor fails, or if the sensor produces measurements that are inappropriate for the drilling operation, it may be necessary to stop the drilling operation until the problem can be diagnosed and remedial work can be performed.

It will, thus, be readily appreciated that improvements are continually needed in the art of controlling drilling operations. The present specification provides such improvements, which may be used with a variety of different types of drilling operations, such as (but not limited to) managed pressure drilling, under-balanced drilling, over-balanced drilling, pressure-balanced drilling, etc.

DETAILED DESCRIPTION

Figure 1:
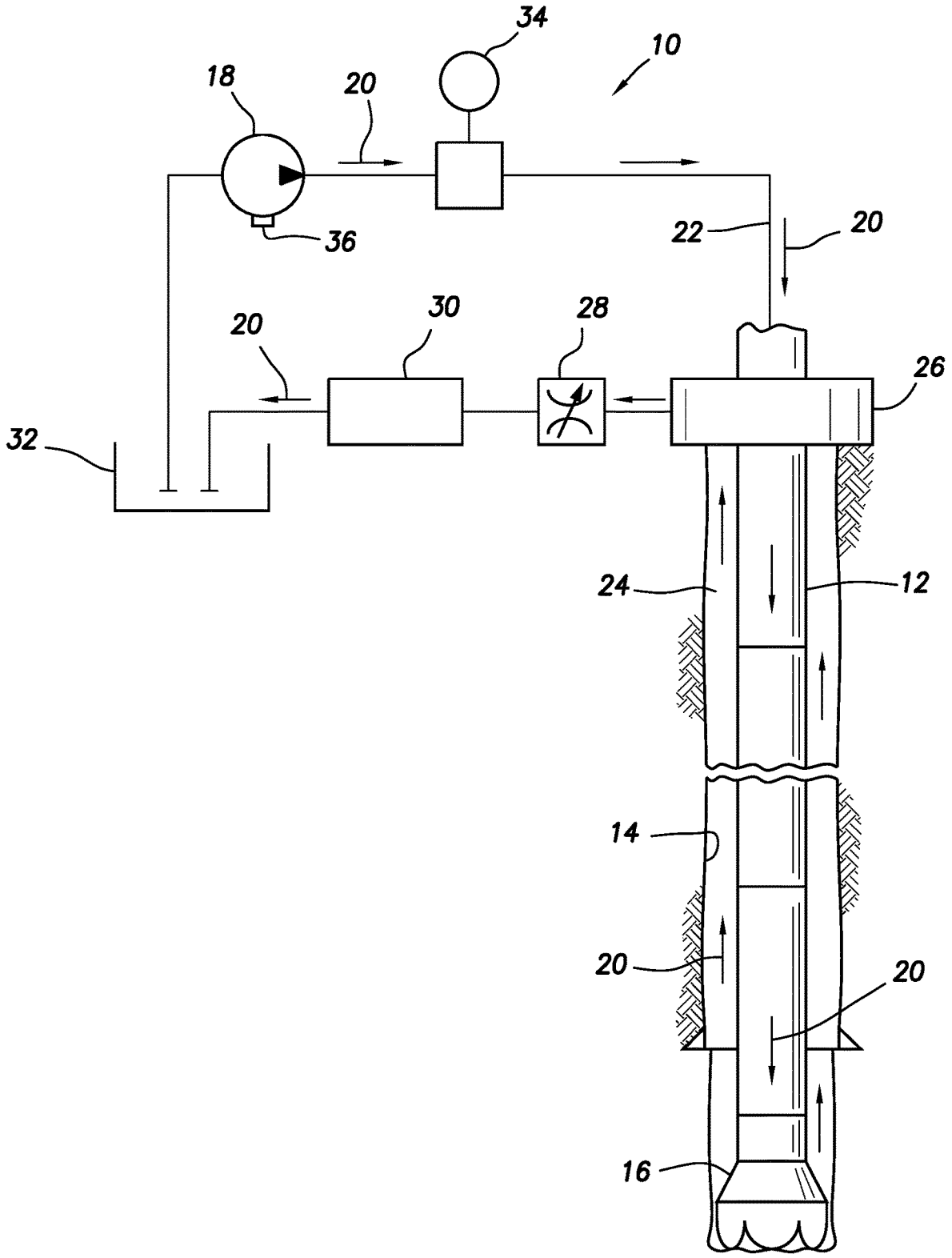
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method as described herein and/or depicted in the drawings.

In the FIG. 1 example, a tubular string 12 is positioned in a wellbore 14. The tubular string 12 is a drill string having a drill bit 16 connected at a distal end thereof for the purpose of drilling into the earth. The system 10 is configured to perform a type of drilling operation known to those skilled in the art as a "managed pressure" drilling operation, in which pressure in the wellbore 14 is precisely controlled. However, the scope of this disclosure is not limited to any particular type of drilling operation.

As depicted in FIG. 1, a pump 18 is used to maintain a fluid flow 20 through the tubular string 12 in the wellbore 14. In this example, the fluid flow 20 enters the tubular string 12 at the surface via a standpipe 22, which may be connected to the tubular string via a top drive, a kelly, or other equipment (not shown). The fluid flow 20 exits the tubular string 12 in the wellbore 14 via nozzles (not shown) in the drill bit 16.

The fluid flow 20 returns to the surface via an annulus 24 formed between the tubular string 12 and the wellbore 14. In managed pressure drilling operations, the annulus 24 may be isolated from the atmosphere at the surface by well equipment 26 known to those skilled in the art as a rotating control device, rotating drilling head, rotating blowout preventer, rotating control head, etc. In well control operations, the well equipment 26 may be an annular blowout preventer, pipe rams, or other equipment. However, the scope of this disclosure is not limited to use of any well equipment to isolate an annulus from the atmosphere at the surface.

The returned fluid flow 20 may pass through a choke 28 and various types of fluid conditioning equipment 30 (such as, a gas separator, a shale shaker, etc.) prior to flowing into a reservoir 32 (also known as a "mud pit"). The pump 18 draws fluid from the reservoir 32. Note that the FIG. 1 example is simplified for purposes of clarity of illustration and description, and those skilled in the art will appreciate that additional equipment or different equipment may be used, depending in part on the particular well operation being performed.

In the FIG. 1 example, a pressure sensor 34 is connected between the pump 18 and the tubular string 12. The pressure sensor 34 can be used to determine a frictional pressure drop in the well system 10.

A flow rate of the fluid flow 20 can be measured by a flow rate sensor 36, such as a pump stroke sensor connected to the pump 18, or a flow meter. Thus, a pressure and flow rate of the fluid flow 20 exiting the pump 18 are measured as the fluid flow is being introduced into the well. In some examples, another pressure sensor (or another type of sensor) may also measure characteristics of the fluid flow 20 after it exits the well (such as, a pressure sensor that measures pressure in the annulus 24 and a flow meter connected downstream of the choke manifold 28).

In the FIG. 1 example, the pump 18 may be of the type known as a triplex pump or rig pump. As mentioned above, the flow rate sensor 36 can be a stroke sensor connected to the pump 18, and which can measure a flow rate of the fluid flow 20 from the pump by measuring a number of pump strokes in a given amount of time. In other examples, a flow meter may be used to measure the flow rate of the fluid flow 20.

It is important in a drilling operation to continuously be aware of the pressure and flow rate of the fluid flow 20 into the tubular string 12, since these parameters (as well as other parameters, such as a density of the fluid, the flow rate of the fluid out of the well, etc.) directly affect the pressure in the wellbore 14. In the system 10, a hydraulics model (see FIG. 2) will use the pressure and flow rate of the fluid flow 20 into the tubular string 12 (and other measured parameters) to determine how the drilling operation should be controlled in order to achieve certain objectives (such as, well control, efficient drilling, avoidance of excessive fluid loss, etc.).

Control of the well could, therefore, be jeopardized in some situations if an output of one of the sensors 34, 36 is actually or apparently lost or unavailable. For example, if the hydraulics model is not receiving an expected output of the flow rate sensor 36, the hydraulics model might be incapable of determining how the drilling operation should be controlled. Furthermore, a source of the problem (e.g., a failure of the flow rate sensor 36, or a failure of the pump 18 itself) might be unknown, thereby preventing the problem from being expeditiously resolved.

As described more fully below, the system 10 includes a control system (see FIG. 2) that is specially configured so that a drilling operation can continue, and can successfully achieve the desired objectives, even if there is a failure of the flow rate sensor 36 or the pressure sensor 34. In addition, control of the well can be maintained, even if there is a failure of the pump 18. The control system can quickly determine which problem has occurred, so that the problem can be expeditiously resolved and normal drilling operations can resume or continue.

Figure 2:
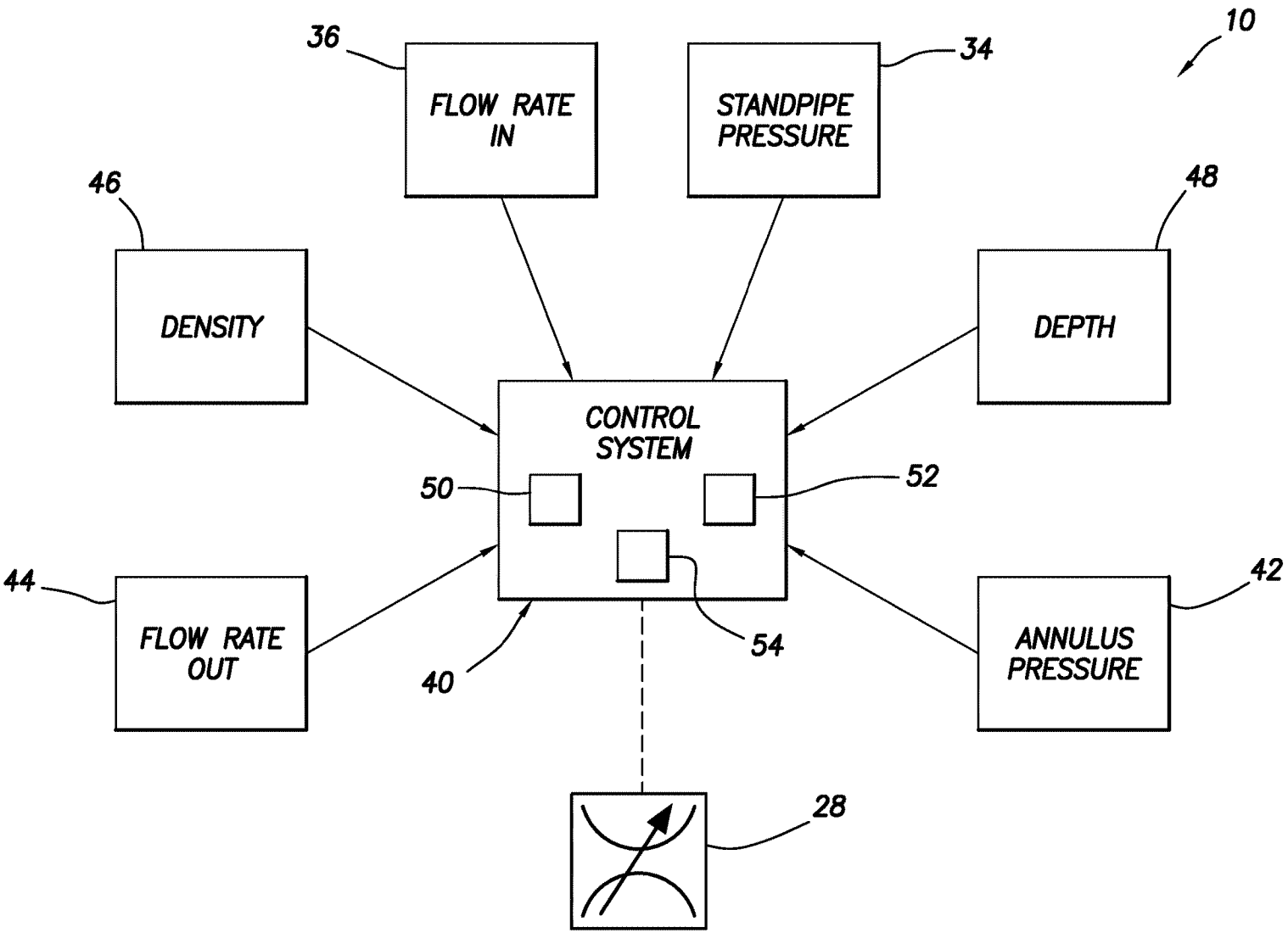
FIG. 2 is a representative schematic view of an example of a drilling operation control system that may be used with the well system and method of FIG. 1.

Referring additionally now to FIG. 2, certain components of the FIG. 1 well system 10 are representatively illustrated in schematic form. In this view, it may be seen that the well system 10 includes a drilling operation control system 40 that receives the outputs of the pressure and flow rate sensors 34, 36. In this example, the control system 40 also receives outputs of an annulus pressure sensor 42 that measures pressure in the annulus 24, a flow rate sensor 44 that measures the flow rate of the fluid flow 20 out of the wellbore 14, density measurements 46 and wellbore depth measurements 48. More, fewer or different measurements may be received by the control system 40 in other examples.

The control system 40 can include memory for receiving and storing the measurements 46, 48 and the outputs of the sensors 34, 36, 42, 44, and one or more processors for performing calculations with this stored data. The control system 40 can be configured so that statistical analyses can be performed on the data, so that determinations can be made as to how the drilling operation should be controlled, and so that the drilling operation is actually controlled based on those determinations.

In the FIG. 2 example, the control system 40 includes a statistical model 50, a hydraulics model 52 and a controller 54. These features of the control system 40 may be implemented using any suitable combination of software/instructions and hardware (e.g., memory, processors, etc.).

The statistical model 50 in this example is at least configured to determine a statistical correlation between the measured outputs of the pressure sensor 34 and the flow rate sensor 36. The statistical model 50 is also configured to calculate an output of the flow rate sensor 36 based on the measured pressure sensor 34 output in the event that the measured output of the flow rate sensor is unavailable.

Alternatively, the statistical model 50 is configured to calculate an output of the pressure sensor 34 based on the measured flow rate sensor 36 output in the event that the measured output of the pressure sensor is unavailable. If any of the outputs of the sensors 34, 36, 42, 44 or the measurements 46, 48 are statistically correlated with another sensor or measurement, then the statistical model 50 can be used to calculate the output of a sensor from which data has been lost, based on the statistically correlated output of another sensor or measurement.

The statistical model 50 may use any suitable type of statistical analysis to determine whether a statistical correlation exists between the measured outputs of the sensors 34, 36. For example, the statistical model 50 may use a regression analysis to determine a "P" value based on the measured outputs of the sensors 34, 36. A statistical correlation may be found if the P value is sufficiently small (such as, less than 0.05).

The hydraulics model 52 in this example is at least configured to determine how the drilling operation should be controlled to achieve a desired objective (such as, maintaining well control, achieving a desired penetration rate, preventing excessive fluid loss, combinations of these, etc.). In the event of a loss of one of the sensor 34, 36 outputs, or a failure of an item of equipment (such as the pump 18) whose output is measured by the sensor, the hydraulics model 52 is further configured to determine, based on the other sensor output calculated by the statistical model 50, how the drilling operation should be controlled. Any suitable hydraulics model may be used in the control system 40, such as (but not limited to) the Victus™ system marketed by Weatherford International, LLC of Houston, Texas USA.

The controller 54 is configured to control the drilling operation, based on outputs of the hydraulics model 52 (such as a desired annulus 24 pressure set point). For example, the controller 54 can control operation of the choke 28 to thereby vary a restriction to the fluid flow 20 from the annulus 24. An increased restriction will tend to increase pressure in the wellbore 14, and a decreased restriction will tend to decrease pressure in the wellbore, in the FIG. 1 system 10.

The controller 54 may be provided in the form of a programmable logic controller (PLC). A proportional-integral-derivative (PID) algorithm may be used to implement the control function, so that a desired result is achieved by the controller 54. However, the scope of this disclosure is not limited to use of any particular type of controller.

In one example, the control system 40 can receive the outputs of the sensors 34, 36, 42, 44 each second in real time as the drilling operation progresses. The statistical model 50 can perform the statistical analysis (e.g., a regression analysis) periodically, such as, each time a connection is made in the tubular string 12, using the last 500 recorded measurements of each sensor. For example, if a determination is to be made as to whether the outputs of the sensors 34, 36 are statically correlated, the statistical model 50 can use the last 500 recorded measurements of the sensor 34 and the last 500 recorded measurements of the sensor 36 in the analysis. However, the scope of this disclosure is not limited to use of any particular measurement frequency, any particular analysis frequency, or any particular number of measurements used in the analysis.

Figure 3:
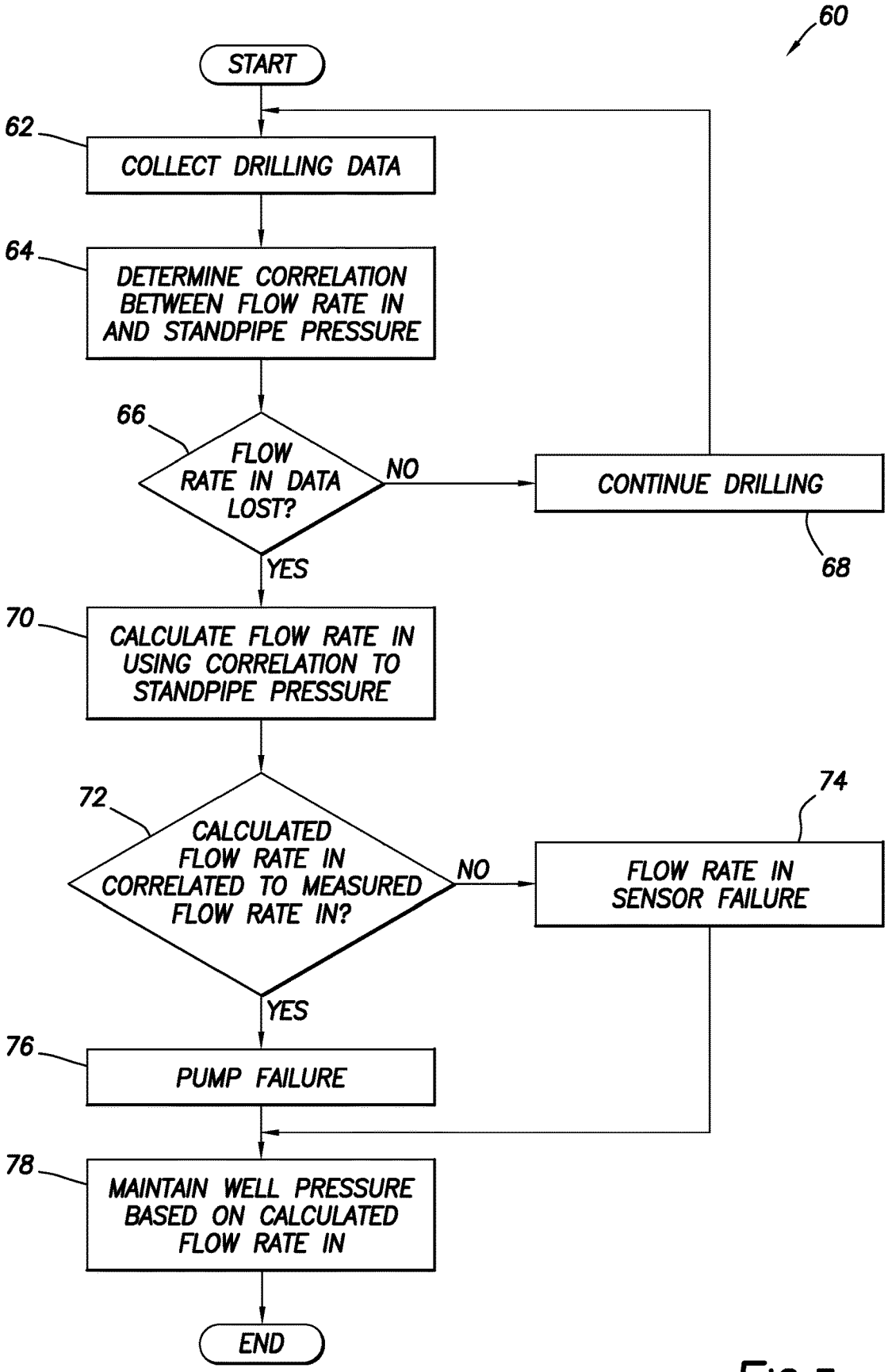
FIG. 3 is a representative flowchart for an example of a method of controlling a drilling operation.

Referring additionally now to FIG. 3, a flowchart for an example method 60 of controlling a drilling operation is representatively illustrated. The method 60 may be used with the well system 10 of FIGS. 1 & 2, or the method may be used with other well systems.

In step 62, drilling data is collected. In the well system 10 described above, the measurements output by the sensors 34, 36, 42, 44 are received by the control system 40 each second during the drilling operation. The density and depth measurements 46, 48 may be input to the control system 40 less frequently in some examples. However, the scope of this disclosure is not limited to any particular frequency of receiving drilling data.

In step 64, a determination is made as to whether there is a statistical correlation between the measurements made by the pressure sensor 34 and the flow rate sensor 36. In the example described above, the last 500 measurements made by each of the sensors 34, 36 are used in the statistical analysis, and the correlation determination is performed each time a connection is made in the tubular string 12. However, the scope of this disclosure is not limited to use of any particular number of measurements, or to any particular frequency of determining the correlation.

It is expected that in most drilling operations these measurements are sufficiently correlated (e.g., with a P value of less than 0.05 in a regression analysis), so that if one of the sensors' measurements is known, the other sensor's measurements can be calculated based on the statistical analysis. In the further description of the method 60 below, the output of the flow rate sensor 36 can be calculated based on the measured output of the pressure sensor 34, but in other examples the output of the pressure sensor could be calculated based on the measured output of the flow rate sensor.

In step 66, the control system 40 evaluates whether the measured output of the flow rate sensor 36 continues to be received (e.g., every second during the drilling operation). If the flow rate sensor 36 experiences a failure or malfunction, the measurements may not be received at all by the control system 40. If the pump 18 has failed or malfunctioned, then measurements output by the flow rate sensor 36 may indicate no flow at all, which would be unexpected during the drilling operation.

As used herein, both of a failure to receive measurements of the flow rate sensor 36 and a receiving of unexpectedly low measurements from the flow rate sensor can be referred to as a loss of the flow rate data. If there has been no loss of the flow rate data (e.g., apparently valid measurements continue to be received from the flow rate sensor 36) in step 66, then the method 60 proceeds to step 68 and the drilling operation continues.

If, however, the flow rate data has been lost (e.g., either the flow rate measurements are not being received, or the received flow rate measurements are unexpectedly low), a determination will be made as to the cause of the lost flow rate data. In this example, the cause for the lost flow rate data may be a failure of the flow rate sensor 36 or a failure of the pump 18.

In step 70, the output of the flow rate sensor 36 is calculated using the statistical correlation determined in step 64. That is, the measured output of the pressure sensor 34 is used to calculate what the output of the flow rate sensor 36 should be, according to the previous statistical analysis.

In step 72, a determination is made as to whether the calculated output of the flow rate sensor 36 (from step 70) is statistically correlated to the measured output of the flow rate sensor. A regression analysis may be used in the statistical model 50 for this step.

If there is a statistical correlation between the calculated and measured outputs of the flow rate sensor 36, then the measurements being made by the flow rate sensor are apparently valid, and so the flow rate sensor has not failed. Instead, the pump 18 has failed (step 76), thereby causing the measurements to indicate an unexpectedly low flow rate.

If there is not a statistical correlation between the calculated and measured outputs of the flow rate sensor 36, then the measurements being made by the flow rate sensor are apparently invalid, and so the pump 18 has not failed. Instead, the flow rate sensor 36 has failed (step 74), thereby causing the measurements to be lost.

In step 78, pressure in the wellbore 14 is maintained by the control system 40, based on the calculated output of the flow rate sensor 36 (from step 70). If the flow rate sensor 36 has failed, then the drilling operation can continue, with the control system 40 using the calculated output of the flow rate sensor 36, until the flow rate sensor can be replaced or repaired, at which time use of the measured output of the flow rate sensor by the control system can be resumed. Thus, the drilling operation can continue uninterrupted, with pressure in the wellbore 14 being appropriately controlled and maintained (step 78) even though the flow rate data has been lost.

If the pump 18 has failed, the control system 40 can control and maintain the pressure in the wellbore 14, in order to maintain well control. For example, the controller 54 can increase the restriction to flow through the choke 28 to thereby increasingly restrict, or even entirely prevent, the fluid flow 20 from the annulus 24 at the surface. The drilling operation can then resume after the pump 18 has been replaced or repaired.

It will be appreciated that the expeditious determination of whether the flow rate sensor 36 or the pump 18 has failed enables the control system 40 to appropriately control the drilling operation by either permitting the drilling operation to continue (with the control system using the calculated output of the flow rate sensor 36 provided in step 70) in the event of a failure of the flow rate sensor, or permitting control of the well to be maintained in the event of a failure of the pump 18. This expeditious determination also allows needed remedial work (e.g., replacement or repair of the flow rate sensor 36 or the pump 18) to be identified and performed without delay.

The above disclosure provides to the art a method 60 of controlling a well drilling operation. In one example, the method 60 can include: receiving measured outputs of first and second sensors 34, 36 in real time during the drilling operation (step 62); determining that the measured outputs of the first and second sensors 34, 36 are correlated (step 64); calculating a calculated second sensor output based on the measured first sensor output (step 70); and in response to one of the group consisting of a) a loss of the measured second sensor output and b) a failure of an item of equipment (such as the pump 18) whose output is measured by the second sensor, controlling the drilling operation based on the calculated second sensor output (step 78).

The controlling step 78 may include adjusting a restriction to flow through a choke 28.

The first sensor may comprise a pressure sensor 34. The second sensor may comprise a flow rate sensor 36 that measures a parameter (such as pump stroke rate) corresponding to a rate of flow of a fluid 20 into a drill string 12.

The first sensor may comprise a flow rate sensor 36 that measures a parameter corresponding to a rate of flow of a fluid 20 into a drill string 12. The second sensor may comprise a pressure sensor 34.

The method 60 can include determining whether the calculated second sensor output and the measured second sensor output are statistically correlated (step 72).

The method 60 can include determining that the second sensor has failed (step 74), in response to a lack of statistical correlation between the calculated second sensor output and the measured second sensor output (step 72).

The item of equipment may comprise a pump 18. The method 60 can include determining that the pump 18 has failed (step 76), in response to a finding that the calculated second sensor output and the measured second sensor output are statistically correlated (step 72).

Also provided to the art by the above disclosure is a drilling operation control system 40. In one example, the control system 40 can comprise: a statistical model 50 configured to determine a statistical correlation between measured outputs of first and second sensors 34, 36, and to calculate a calculated second sensor output based on the measured first sensor output; a controller 54 configured to control the drilling operation; and a hydraulics model 52 configured to determine how the drilling operation should be controlled to achieve a desired objective. The hydraulics model 52 is further configured to determine, based on the calculated second sensor output, how the drilling operation should be controlled, in response to one of a) a loss of the measured second sensor output and b) a failure of an item of equipment whose output is measured by the second sensor.

The controller 54 may be configured to adjust a restriction to flow through a choke 28 during the drilling operation.

The first sensor may comprise a pressure sensor 34. The second sensor may comprise a flow rate sensor 36 configured to measure a parameter (such as pump stroke rate) corresponding to a rate of flow of a fluid 20 into a drill string 12.

The first sensor may comprise a flow rate sensor 36 configured to measure a parameter corresponding to a rate of flow of a fluid 20 into a drill string 12. The second sensor may comprise a pressure sensor 34.

The statistical model 50 may be further configured to determine whether the calculated second sensor output and the measured second sensor output are statistically correlated. The statistical model 50 may be further configured to determine that the second sensor has failed, in response to a lack of statistical correlation between the calculated second sensor output and the measured second sensor output.

The item of equipment may comprise a pump 18. The statistical model 50 may be further configured to determine that the pump 18 has failed, in response to a finding that the calculated second sensor output and the measured second sensor output are statistically correlated.

A method 60 of controlling a well drilling operation described above can comprise: receiving measured outputs of a pressure sensor 34 and a flow rate sensor 36 in real time during the drilling operation; determining that the measured outputs of the pressure and flow rate sensors 34, 36 are correlated; calculating a calculated flow rate sensor 36 output based on the measured pressure sensor 34 output; and in response to a) a loss of the measured flow rate sensor 36 output or b) a failure of an item of equipment whose output is measured by the flow rate sensor 36, controlling the drilling operation based on the calculated flow rate sensor 36 output.

The controlling step may comprise adjusting a restriction to flow through a choke 28.

The flow rate sensor 36 may measure a parameter corresponding to a rate of flow of a fluid 20 into the drill string 12.

The method 60 may include determining whether the calculated flow rate sensor 36 output and the measured flow rate sensor 36 output are statistically correlated. The method 60 may further include determining that the flow rate sensor 36 has failed, in response to a lack of statistical correlation between the calculated flow rate sensor 36 output and the measured flow rate sensor 36 output.

The item of equipment may comprise a pump 18. The method 60 may include determining that the pump 18 has failed, in response to a finding that the calculated flow rate sensor 36 output and the measured flow rate sensor 36 output are statistically correlated.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of controlling a well drilling operation, the method comprising:

receiving measured outputs of first and second sensors in real time during the drilling operation;

determining that the measured outputs of the first and second sensors are correlated;

calculating a calculated second sensor output based on the measured first sensor output;

determining whether the calculated second sensor output and the measured second sensor output are statistically correlated;

determining that an item of equipment whose output is measured by the second sensor has failed, in response to a finding that the calculated second sensor output and the measured second sensor output are statistically correlated; and controlling the drilling operation based on the calculated second sensor output, in which the controlling comprises adjusting a restriction to flow through a choke.

2. The method of claim 1, in which the first sensor comprises a pressure sensor, and the second sensor comprises a flow rate sensor that measures a parameter corresponding to a rate of flow of a fluid into a drill string.

3. The method of claim 1, in which the first sensor comprises a flow rate sensor that measures a parameter corresponding to a rate of flow of a fluid into a drill string, and the second sensor comprises a pressure sensor.

4. The method of claim 1, further comprising determining that the second sensor has failed, in response to a lack of statistical correlation between the calculated second sensor output and the measured second sensor output.

5. The method of claim 1, in which the item of equipment comprises a pump, and further comprising determining that the pump has failed, in response to the finding that the calculated second sensor output and the measured second sensor output are statistically correlated.

6. A drilling operation control system, comprising:

a statistical model configured to determine a statistical correlation between measured outputs of first and second sensors, and to calculate a calculated second sensor output based on the measured first sensor output;

a controller configured to control the drilling operation; and a hydraulics model configured to determine how the drilling operation should be controlled to achieve a desired objective, and in which the hydraulics model is further configured to determine, based on the calculated second sensor output, how the drilling operation should be controlled, in response to a failure of an item of equipment whose output is measured by the second sensor.

7. The drilling operation control system of claim 6, in which the controller is configured to adjust a restriction to flow through a choke during the drilling operation.

8. The drilling operation control system of claim 6, in which the first sensor comprises a pressure sensor, and the second sensor comprises a flow rate sensor configured to measure a parameter corresponding to a rate of flow of a fluid into a drill string.

9. The drilling operation control system of claim 6, in which the first sensor comprises a flow rate sensor configured to measure a parameter corresponding to a rate of flow of a fluid into a drill string, and the second sensor comprises a pressure sensor.

10. The drilling operation control system of claim 6, in which the statistical model is further configured to determine whether the calculated second sensor output and the measured second sensor output are statistically correlated.

11. The drilling operation control system of claim 10, in which the item of equipment comprises a pump, and in which the statistical model is further configured to determine that the pump has failed, in response to a finding that the calculated second sensor output and the measured second sensor output are statistically correlated.

12. The drilling operation control system of claim 10, in which the statistical model is further configured to determine that the second sensor has failed, in response to a lack of statistical correlation between the calculated second sensor output and the measured second sensor output.

13. A method of controlling a well drilling operation, the method comprising:

receiving measured outputs of a pressure sensor and a flow rate sensor in real time during the drilling operation;

determining that the measured outputs of the pressure and flow rate sensors are correlated;

calculating a calculated flow rate sensor output based on the measured pressure sensor output; and in response to one of the group consisting of a) a loss of the measured flow rate sensor output and b) a failure of an item of equipment whose output is measured by the flow rate sensor, controlling the drilling operation based on the calculated flow rate sensor output.

14. The method of claim 13, in which the controlling comprises adjusting a restriction to flow through a choke.

15. The method of claim 13, in which the flow rate sensor measures a parameter corresponding to a rate of flow of a fluid into a drill string.

16. The method of claim 13, further comprising determining whether the calculated flow rate sensor output and the measured flow rate sensor output are statistically correlated.

17. The method of claim 16, further comprising determining that the flow rate sensor has failed, in response to a lack of statistical correlation between the calculated flow rate sensor output and the measured flow rate sensor output.

18. The method of claim 16, in which the item of equipment comprises a pump, and further comprising determining that the pump has failed, in response to a finding that the calculated flow rate sensor output and the measured flow rate sensor output are statistically correlated.

* * * * *